US006643949B2

(12) United States Patent
Yen

(10) Patent No.: US 6,643,949 B2
(45) Date of Patent: Nov. 11, 2003

(54) HEAT-DRYING DEVICE OF A KNIFE HOLDER

(76) Inventor: Lin Wen Yen, 9F 3R, No. 210, Chung Hsueh Rd., Taipei (TW)

( * ) Notice: Subject to any disclaimer, the term of this patent is extended or adjusted under 35 U.S.C. 154(b) by 0 days.

(21) Appl. No.: 09/976,757

(22) Filed: Oct. 8, 2001

(65) Prior Publication Data

US 2003/0066205 A1 Apr. 10, 2003

(51) Int. Cl.[7] ..... F26B 25/06; A47F 7/00; A47G 21/14

(52) U.S. Cl. ..... 34/202; 211/70.7; 248/37.3

(58) Field of Search ..... 34/201, 202; 211/70.7; 248/37.3; 30/298.4

(56) References Cited

U.S. PATENT DOCUMENTS 3,597,586 A * 8/1971 Rebovich ..... 219/219

6,079,108 A * 6/2000 Lin ..... 30/298.4

* cited by examiner

*Primary Examiner*—Ira S. Lazarus
*Assistant Examiner*—K. B. Rinehart
(74) *Attorney, Agent, or Firm*—Pro-Techtor International Services

(57) ABSTRACT

A heat-drying device of a knife holder includes a heat-generating member installed in a knife groove base of a knife holder consisting of a front shell and a rear shell and an upper cover having a plurality of insert holes for knives to insert. A knife groove base with open knife grooves are fitted in the shell body and has a pull-push water-collecting tray provided at the bottom. A fundamental base is positioned under the shell body and is collapsible for convenience of being placed on a flat surface or on a table. The heat-generating member is installed in the knife groove base and a cement resistor or an electric-heating tube or an electric-heating rod can be used as the heat-generating member to generate heat energy for heat-drying the knife blades inserted in the knife grooves.

1 Claim, 7 Drawing Sheets

HEAT-DRYING DEVICE OF A KNIFE HOLDER

BACKGROUND OF THE INVENTION

This invention relates to a heat-drying device of a knife holder, particularly to one novel in structure, practical in use and capable to heat-dry the knife blades in knife grooves to prevent germs from multiplying thereon.

A conventional knife holder, as shown in FIG. 1, includes a bottom base 1, a knife base 10 and an upper cover 11. The knife base 10 is provided with a plurality of insert grooves 100 spaced apart for the blades of knives 12 to insert therein. The water sticking on the knife blades drop down along the insert grooves 100 in a water-collecting groove 13 on the bottom base 1 after the knife blades are inserted in the insert grooves 100. However, the conventional knife holder has no device for heat-drying and disinfecting the knife edges which are positioned in the insert grooves 100 of a knife holder for a long period of time, easily letting germs multiply therein and greatly affecting user's health.

SUMMARY OF THE INVENTION

This invention has been devised to offer a heat-drying device of a knife holder, practical in use and capable to heat-dry and disinfect the knife blades in the knife grooves, having safe functions in use and keeping knives hygienic.

One feature of the invention is that a heat-generating member is installed in the knife groove base of a knife holder to generate heat energy for heat-drying and disinfecting the knife blades to ensure a user's health.

Another feature of the invention is that high resisting cement resistance, electric-heating wires, electric-heating tubes or electric-heating rods can be used as the heat-generating member of the heat-drying device.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
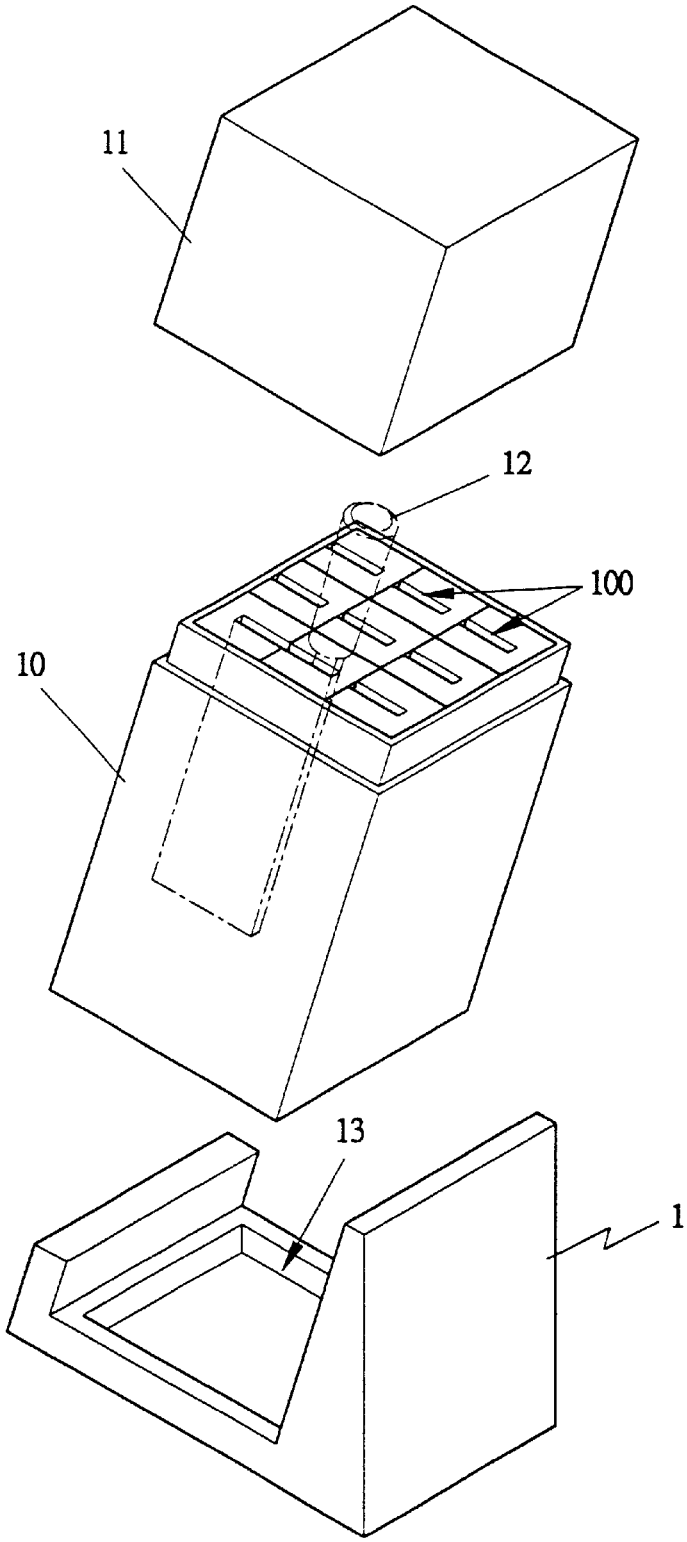
FIG 1 (PRIOR ART)
FIG. 1 is an exploded perspective view of a conventional knife holder.
Figure 2:
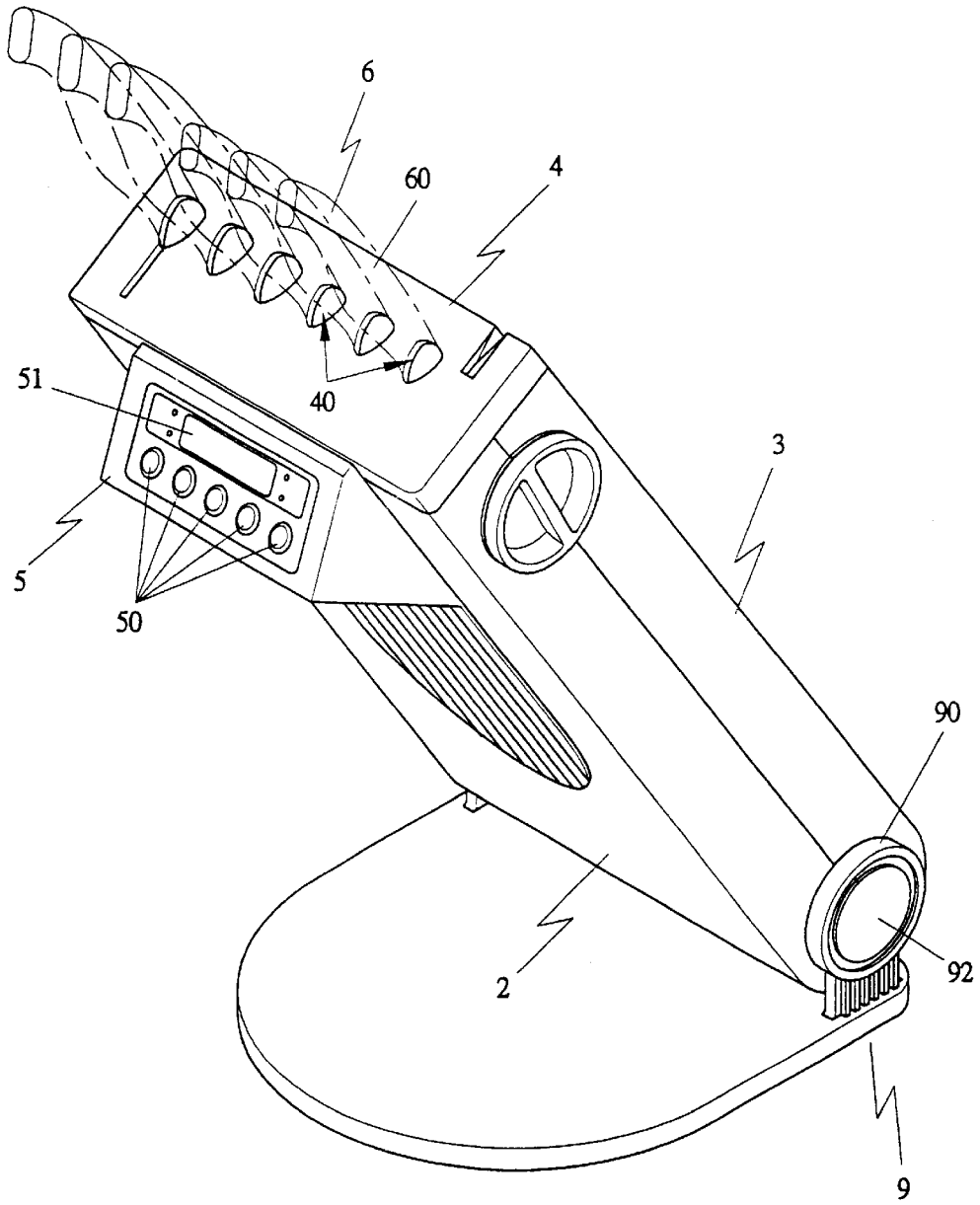
FIG. 2 is a perspective view of a knife holder with a heat-drying device in the present invention.
Figure 3:
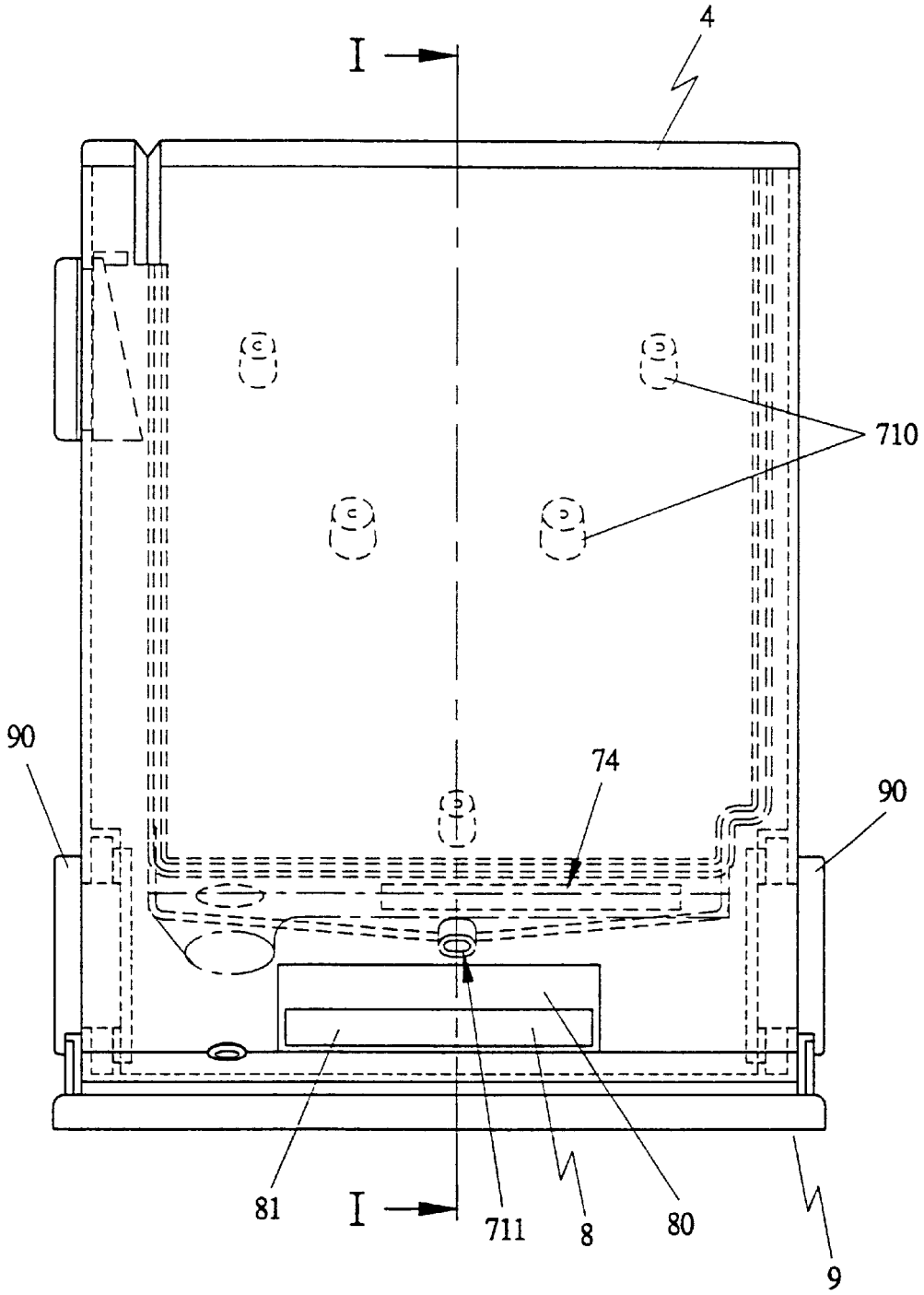
FIG. 3 is a rear side cross-sectional view of the knife holder with a heat-drying device in the present invention.

A preferred embodiment of a heat-drying device of a knife holder in the present invention, as shown in FIGS. 2, 3, includes a heat-drying member 73 in a knife groove base 7 of a knife holder consisting of a front shell 2, a rear shell 3, an upper cover 4 and a faceplate 5 as main components combined together.

The front shell 2 and the rear shell 3 are combined to form a shell body covered around by the upper cover 4. The upper cover 4 is provided with a plurality of insert holes 40 just applicable for a little portion of the knife handles 60 to insert and be kept stably therein, with the knife blades 61 inserted deeply in the knife groove 70 of a knife groove casing 7. A notch 62 is formed between the knife handle 60 and the knife blade 61, and the faceplate 5 having press buttons 50 and an indicating device 51 is provided on a front side of the front shell 2 and fixed firmly thereon. The press button 50 of the faceplate 5 is pressed to show on the indicating device 51 the operating condition of the knife holder.

Figure 4:
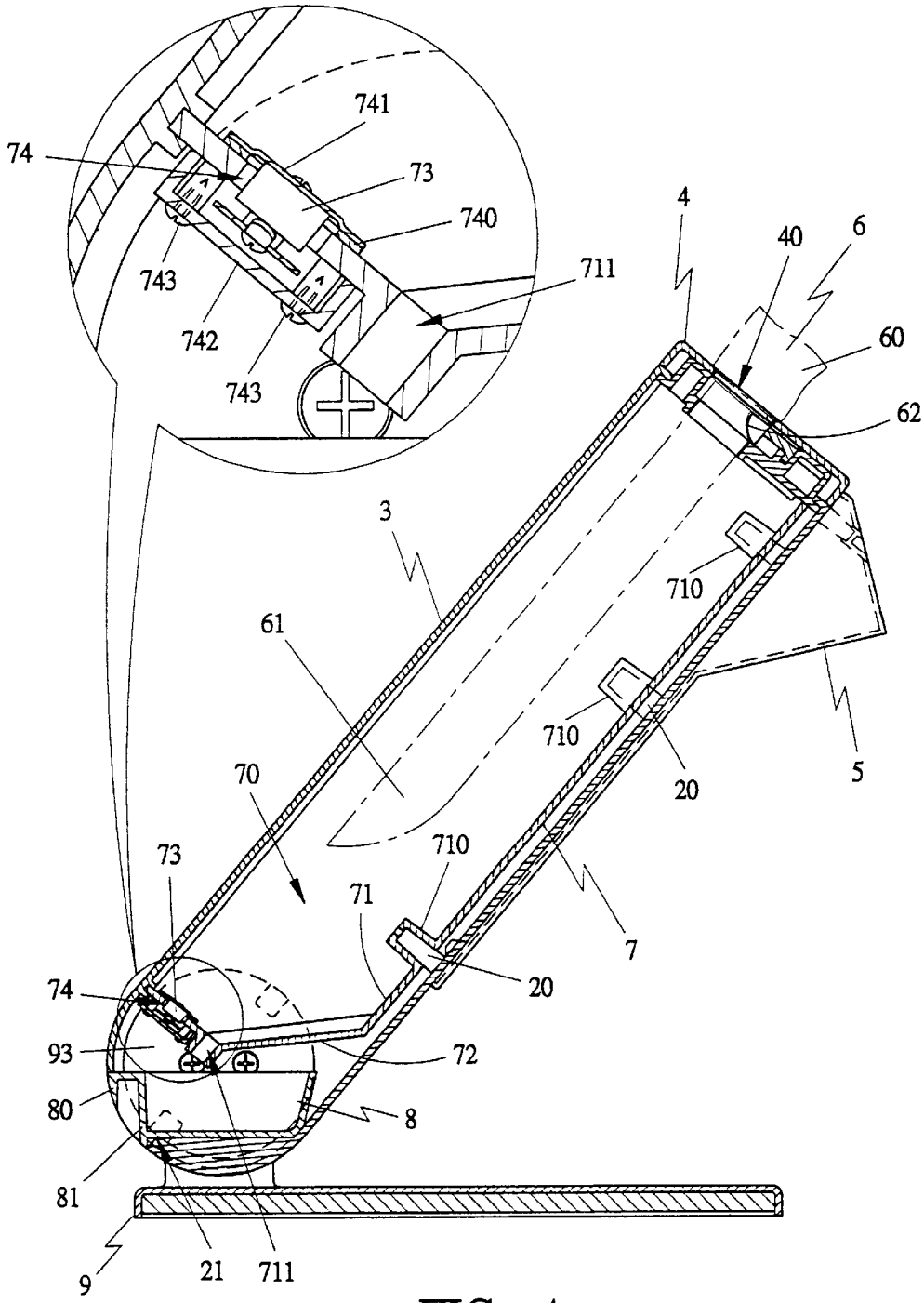
FIG. 4 is a side cross-sectional view and a partially magnified view of the line I—I in FIG. 3.

The knife groove base 7 has an open knife groove 70 and a plurality of combining grooves 710 formed on one side wall 71 for receiving the combining studs 20 of the front shell 2 and combining the knife groove base 7 with the front shell 2 together. Besides, a downward slope 72 is formed at a lower side of the knife groove base 7, having a water guiding hole 711 under to guide the water dropping down from the knife blades 61 into a water-collecting tray 8, as shown in FIG. 4.

In addition, a heat-generating member 73 is installed inside the knife groove base 7, using a cement resistor with an high resistance; or an electric-heating wires; or an electric-heating; tubes or an electric-heating rods. The heat-generating member 73 is secured in a fitting groove 74, covered around by a waterproof sheet 740 and a metal plate 741 is adhered on the surface to transmit the heat energy generated by the heat-generating member 73 to the knife groove 70. After placed in the fitting groove 74, the heat-generating member 73 has its lower side closely covered with a lid 742 and fixed with screws 743 so as to prevent water from seeping in. Thus, the heat source generated by the heat-generating member 73 is transmitted in the knife groove 70 to let the knife blades 61 heat-dried and disinfected therein as well.

Then, a water-collecting tray 8 is fitted in a tray groove 21 and has a pull handle 80, with a space formed between the pull handle 80 and the tray wall 81 for a user's finger to insert therein so that the water-collecting tray 8 can be pushed in or pulled out of the tray groove 21 conveniently, thus easy to pour out the water stored in the water-collecting tray 8 and clean it up.

Figure 5:
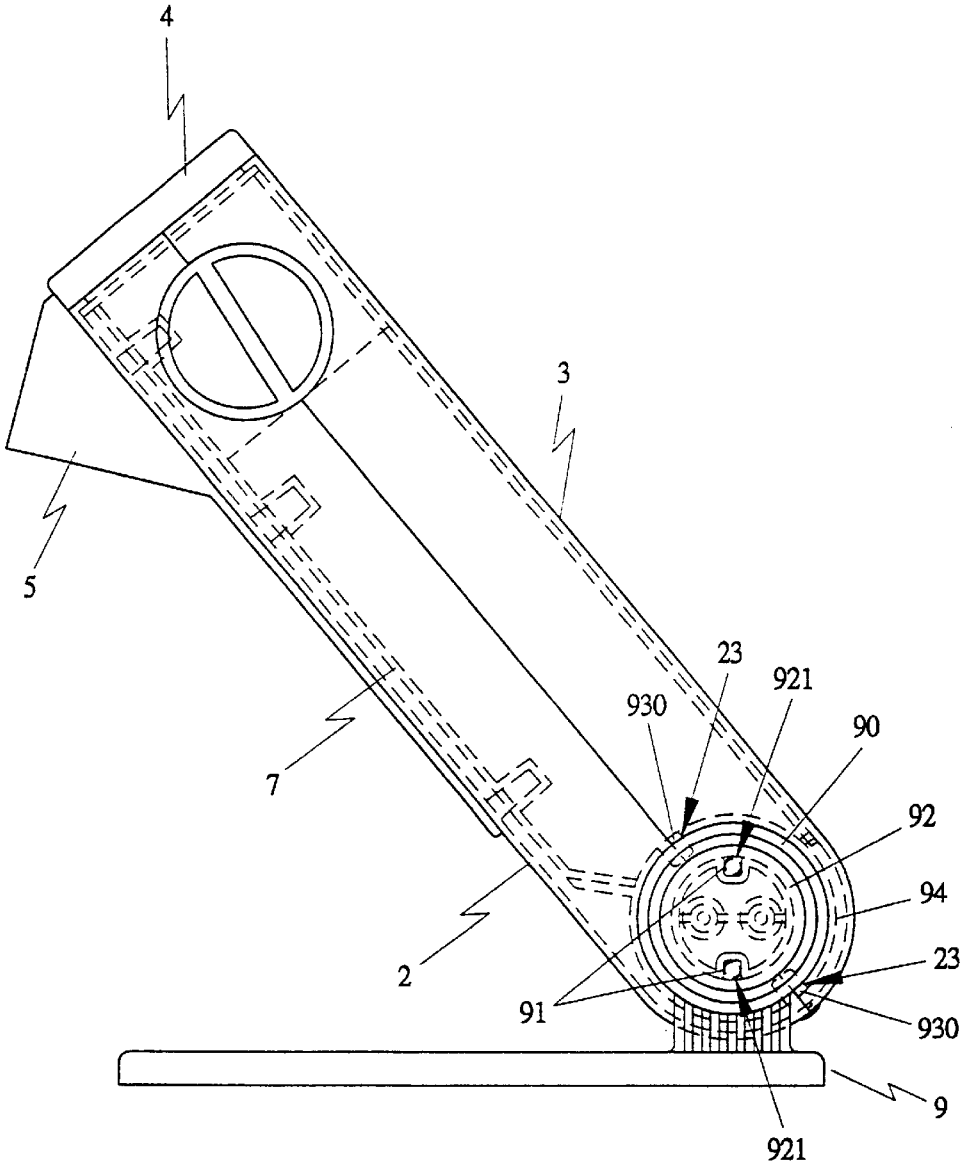
FIG. 5 is a left perspective view of the knife holder with a heat-drying device in the present invention.
Figure 6:
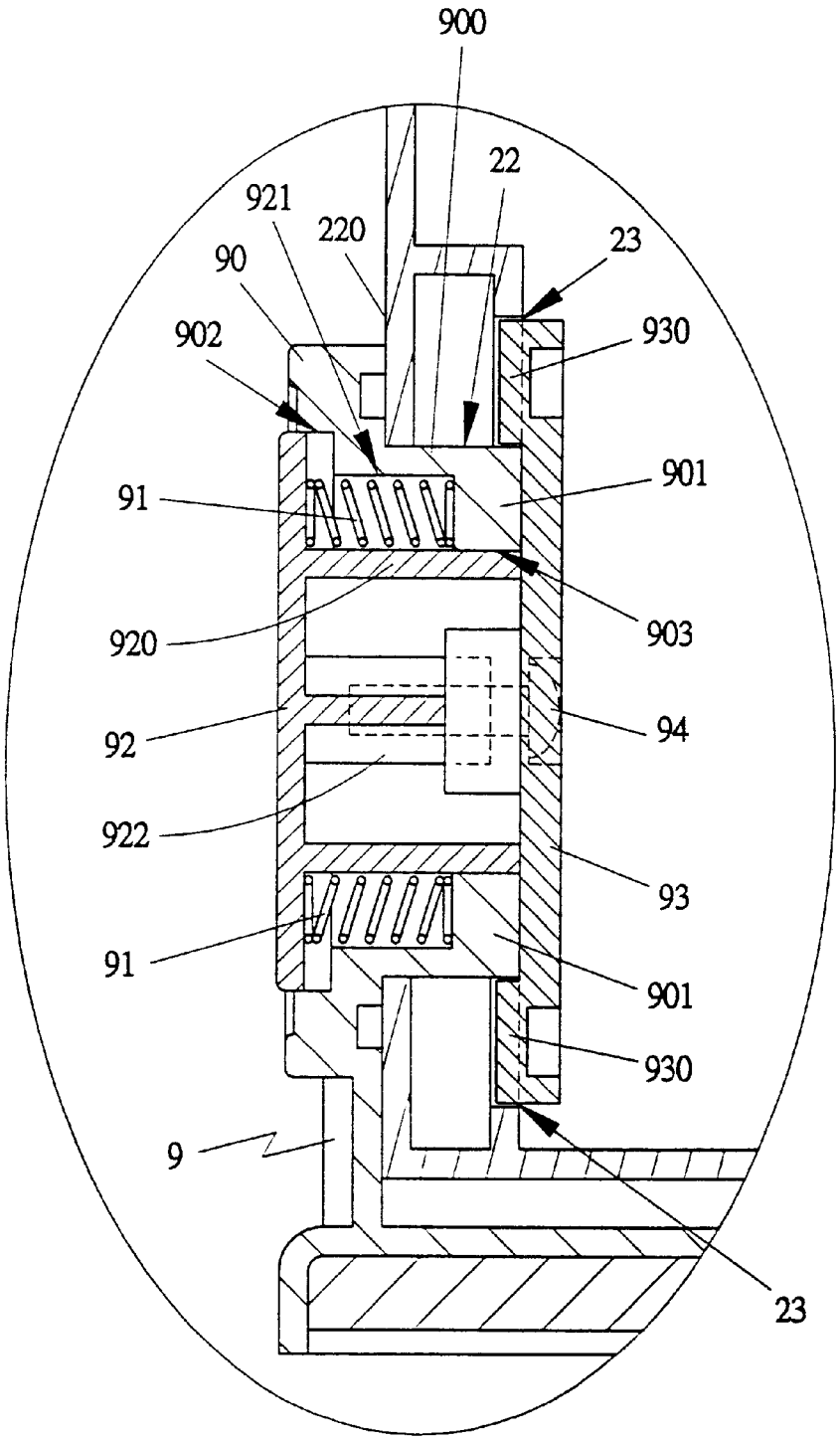
FIG. 6 is a cross-sectional view of the bottom base of the knife holder with heat-drying device in the present invention.
Figure 7:
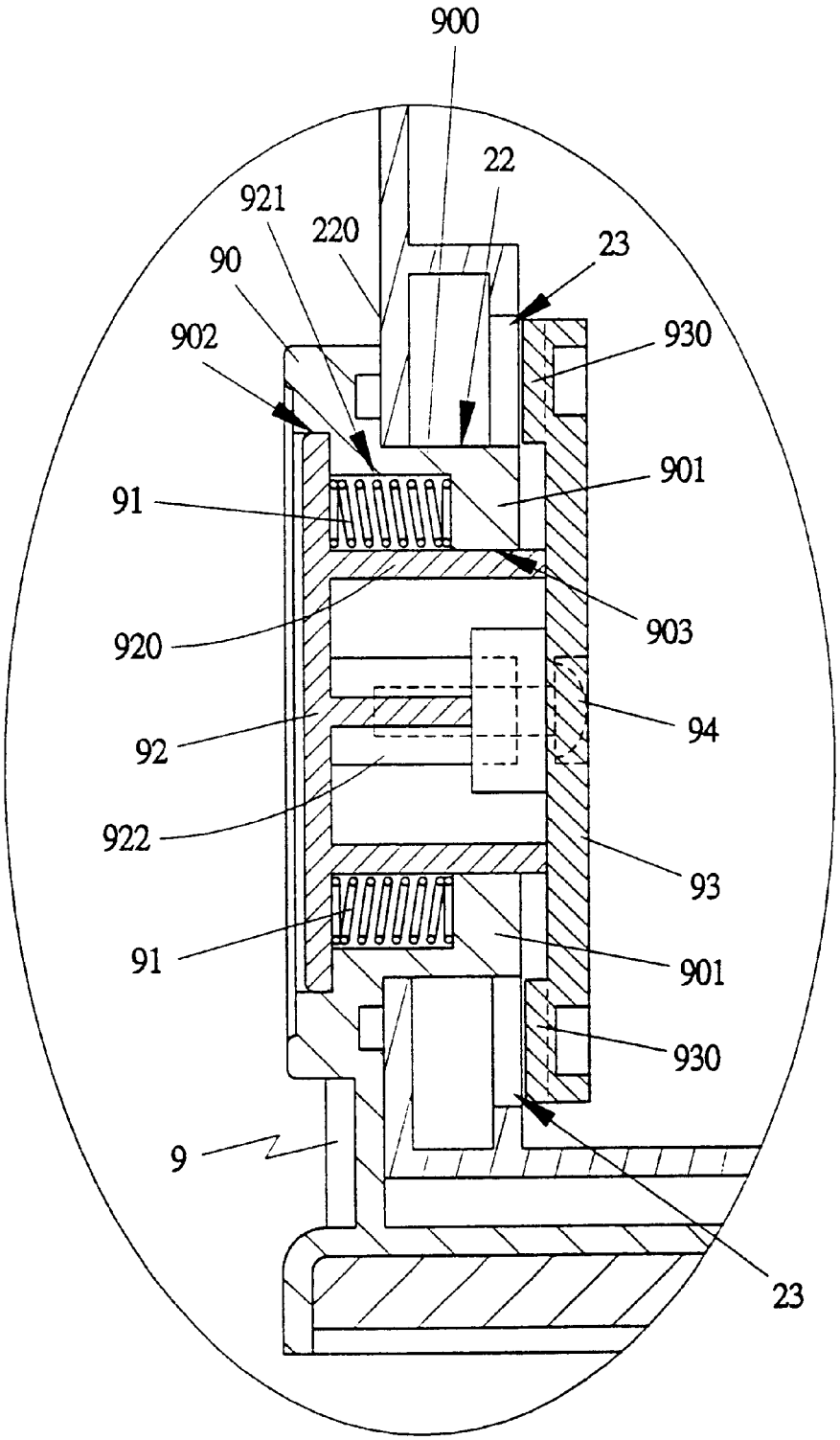
FIG. 7 is another cross-sectional view of the bottom base of the knife holder with a heat-drying device in the present invention.

Further, the combination of the fundamental base 9 with the front and the rear shell 2, 3 are shown in FIGS. 5, 6 and 7. The front shell 2 and the rear shell 3 are combined to form a fundamental base groove 22 receiving a small-diametric portion 900 of a shaft base 90 of the fundamental base 9 and having engaging grooves 23 formed in the inner wall.

Additionally, two spring resisting members 901 positioned symmetrically are provided on the inner wall of the small-diametric portion 900 of the fundamental base 9 to let springs lie in a fixed position. The shaft base 90 further has a large-diametric portion 902 and a shaft hole 903, with the large-diametric portion 902 pushing against the outer wall 220 of the fundamental base groove 22. The neck portion 920 of a shaft sleeve 92 is inserted from outside of the large-diametric portion 902 in the shaft hole 903, having spring grooves 921 formed on an inner wall for receiving springs 91.

Moreover, a side cover 93 is combined with a screw 94 with the tenon 922 of the shaft sleeve 920 via the inner side of the fundamental base groove 22 and provided with two stop members 930 on an inner side to interact with the engaging grooves 23. When the shell body 2,3 and the fundamental base 9 are combined in a condition as shown in FIG. 5, the stop members 930 are moved into the engaging grooves 23 and the fundamental base 9 cannot be collapsed as shown in FIG. 6. In case of collapsing the fundamental base 9, only push inward the shaft sleeve base 920 to compress the springs 91 to force the stop members 930 disengage from the engage grooves 23, as shown in FIG. 7, thus convenient for storing the knife holder.

While the preferred embodiment of the invention has been described above, it will be recognized and understood that various modifications may be made therein and the appended claims are intended to cover all such modifications that may fall within the spirit and scope of the invention.

What is claimed is:

1. A heat-drying device of a knife holder comprising a heat-generating member firmly secured in a fitting groove of a knife holder consisting of a front shell and a rear shell combined to form a shell body covered by an upper cover, said upper cover provided with a plurality of insert holes for knives to insert therein, with knife blades inserted deeply into knife grooves of a knife groove base, said front shell provided on a front side with a faceplate having press buttons and an indicating device;

said knife groove base having a knife groove and a plurality of combination grooves formed on one side wall for receiving the combining studs of said front shell to combine said knife groove base with said front shell together;

a slope is formed at a lower portion of said knife groove base and a water-guiding hole is bored under said slope for guiding water to drop down from the knife blades in a water-collecting tray;

said heat-generating member firmly secured in the fitting groove and covered around with a waterproof sheet, said heat-generating member further having a metal plate adhered on the surface for transmitting heat generated by said heat-generating member to said knife groove for heat-drying and disinfecting, said heat-generating member positioned in said fitting groove closely covered around at a lower side by a groove cover fixed by a screw, thus said heat-generating member is fixed firmly in place and capable to prevent water from seeping in said fitting groove.

* * * * *